US006277422B1

(12) United States Patent
Gale

(10) Patent No.: US 6,277,422 B1
(45) Date of Patent: Aug. 21, 2001

(54) BEVERAGE CONTAINER AND CLOSURE THEREFOR WHICH CAN SERVE AS A COASTER

(75) Inventor: Gregory W. Gale, Napa, CA (US)

(73) Assignee: Regale Corporation, Napa, CA (US)

( * ) Notice: Subject to any disclaimer, the term of this patent is extended or adjusted under 35 U.S.C. 154(b) by 0 days.

(21) Appl. No.: 09/385,913

(22) Filed: Aug. 30, 1999

(51) Int. Cl.[7] ..... A47G 19/22; B65D 41/54; B65D 51/24

(52) U.S. Cl. ..... 426/115; 220/23.86; 220/630; 220/631; 220/737; 220/212; 426/106

(58) Field of Search ..... 220/212, 23.86, 220/214, 319, 804, 806, 378, 630, 703, 729, 737, 738, 740, 744, DIG. 13, 631; D7/503, 509, 511, 396.2; D9/519; 426/110, 106, 122, 115

(56) References Cited

U.S. PATENT DOCUMENTS

| | | | | |
|---|---|---|---|---|
| 26,062 | * | 9/1896 | Hunter | 220/212 |
| 1,509,524 | * | 9/1924 | Morrison | 220/212 |
| 1,666,389 | * | 4/1928 | Mander | 220/23.86 |
| 2,130,651 | * | 9/1938 | Phillips | 220/804 |
| 2,496,792 | * | 2/1950 | Hellberg | 220/212 |
| 3,051,303 | * | 8/1962 | Daanen et al. | 220/212 |
| 3,079,037 | * | 2/1963 | Schechter | 220/212 |
| 3,606,074 | * | 9/1971 | Hayes | 220/212 |
| 5,111,953 | * | 5/1992 | Faust et al. | 220/214 |
| 5,244,106 | * | 9/1993 | Takacs | 220/744 X |
| 5,692,617 | * | 12/1997 | Adams | 220/212 X |
| 5,857,615 | * | 1/1999 | Rose | 220/737 X |

* cited by examiner

*Primary Examiner*—Allan N. Shoap
*Assistant Examiner*—Niki M. Eloshway
(74) *Attorney, Agent, or Firm*—Flehr Hohbach Test Albritton & Herbert LLP

(57) ABSTRACT

In the combination of a beverage container and a closure therefor which can serve as a drinking vessel and a coaster. The beverage container comprises a bowl having a generally hemispherical base and an axis and an upstanding wall circular in cross-section adjoining the generally hemispherical base and being inclined upwardly and inwardly to define a circular lip lying in a plane which is perpendicular to the axis of the hemispherical base and providing an opening providing access to a space within the bowl. The closure comprises a circular rim lying in a plane and having a wall circular in cross-section adjoining the rim and extending downwardly and outwardly and being sized to cover the opening of the container. A cooperative seal is carried by the closure and the container for forming an air-tight seal between the rim of the closure and the lip of the bowl. A band secures the closure to the container to maintain a sealing engagement between the o-ring and the closure and the o-ring and the bowl.

3 Claims, 3 Drawing Sheets

BEVERAGE CONTAINER AND CLOSURE THEREFOR WHICH CAN SERVE AS A COASTER

This invention relates to a beverage container and closure therefor which can serve as a coaster.

Various types of beverage containers have heretofore been provided for providing individual servings of liquor. However, heretofore containers have not been provided for providing individual servings of wine and which also can be utilized as a drinking vessel.

In general, it is an object of the present invention to provide a combination of a beverage container and closure therefor which can serve as a drinking vessel and a coaster.

Another object of the invention is to provide a combination of the above character in which the closure consumes ullage space.

Another object of the invention is to provide a combination of the above character in which the drinking vessel provided by the beverage container is provided with a punt in the hemispherical base so that it can stand on its own.

Another object of the invention is to provide a combination of the above character in which the drinking vessel can be placed on the closure which serves as a coaster.

Another object of the invention is to provide a combination of the above character in which a label is provided on the beverage container.

Another object of the invention is to provide a combination of the above character in which the container and closure are formed of glass.

Another object of the invention is to provide a combination of the above character in which the label is positioned so that it underlies the closure and prevents glass-to-glass contact.

Another object of the invention is to provide a combination of the above character in which an air-tight seal is provided between the closure and the beverage container.

Another object of the invention is to provide a combination of the above character in which the wine within the container is at a level which is an appropriate height for initial consumption of the wine from the container when used as a drinking vessel.

Another object of the invention is to provide a combination of the above character in which a skirt or a band is provided for retaining the closure in engagement with the beverage container prior to use.

Another object of the invention is to provide a combination of the above character in which the skirt or band can be readily removed.

Another object of the invention is to provide a combination of the above character which can be economically manufactured.

Additional objects and features of the invention will appear from the following description in which the preferred embodiments are set forth in detail in conjunction with the accompanying drawings.

Figure 2:
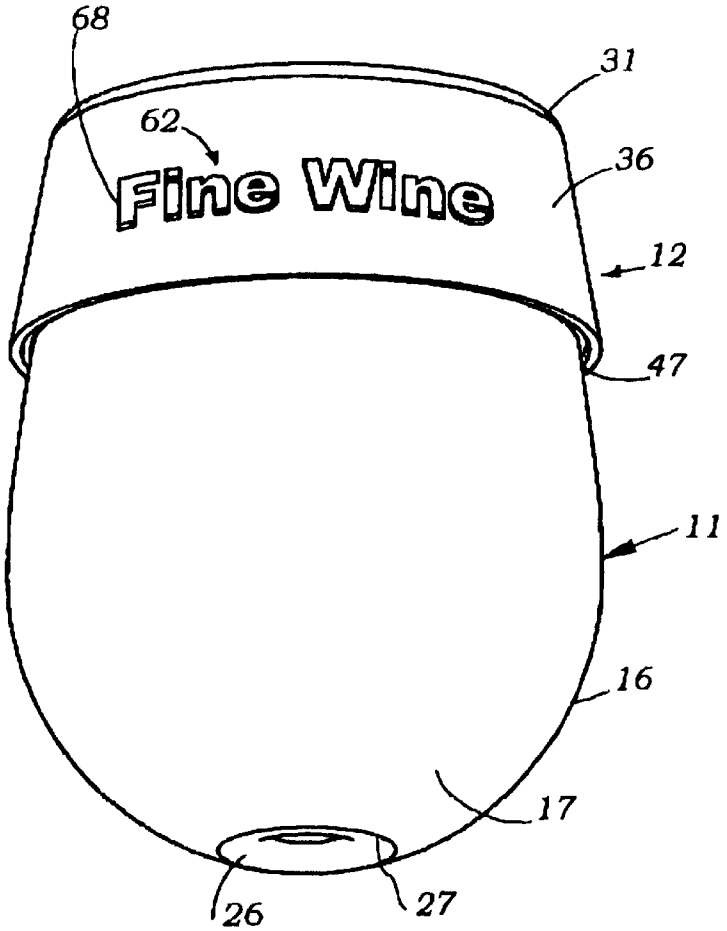
FIG. 2 is another isometric view of the combination beverage container and closure therefor looking upwardly toward the bottom.
Figure 1:
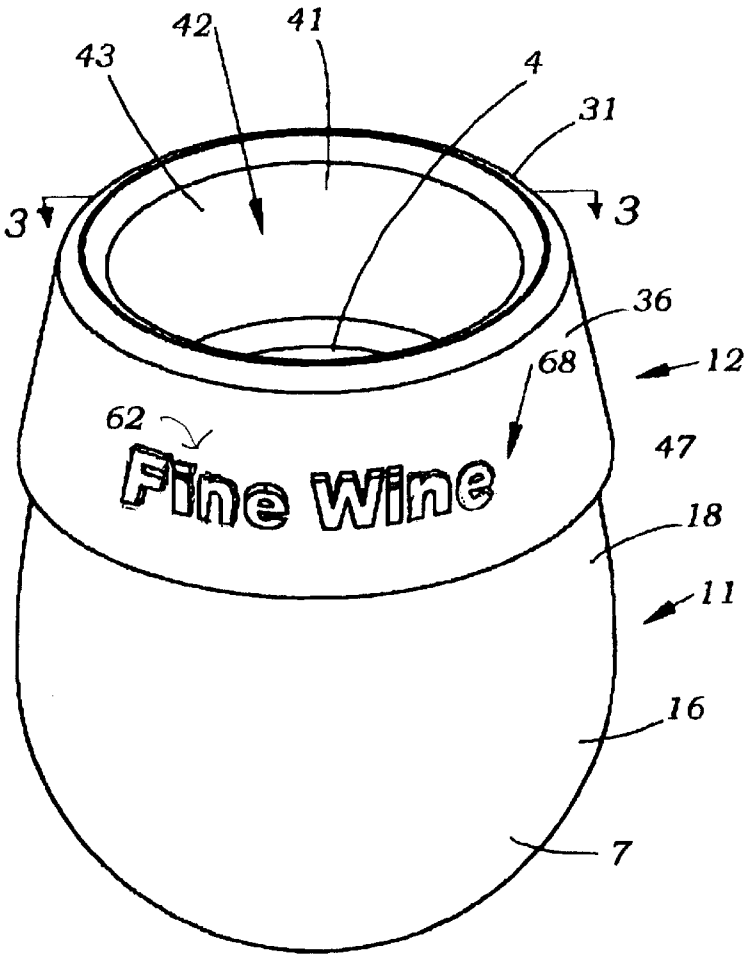
FIG. 1 is an isometric view looking downwardly toward the top of the combination beverage container and closure therefor.

In general, the combination of a beverage container and a closure therefor which can serve as a drinking vessel and a coaster is comprised of a beverage container and a closure. The beverage container is comprised of a bowl having a generally hemispherical base and an upstanding wall which is circular in cross-section adjoining the generally hemispherical base and being inclined upwardly and inwardly to a circular lip defining an open end lying in a plane perpendicular to an imaginary axis extending through the hemispherical base. The closure comprises a circular rim corresponding generally to the size of the circular lip of the container. A wall which is circular in cross-section extends downwardly and outwardly from the rim and is sized to extend over the upwardly and inwardly inclined wall of the container. Means carried by the rim and extends inwardly and downwardly from the rim and is sized to be able to fit within the open end of the beverage container for displacing ullage when the container has a beverage therein. A cooperative sealing means is carried by the closure and the container for forming an air-tight seal with respect to the closure and the container. Means is provided which surrounds the closure and the container to retain the closure in sealing engagement with the container.

More in particular as shown in FIGS. 1 through 6 of the drawings, the combination of the present invention consists of a container 11 and enclosure 12, both being preferably formed of a suitable material such as glass which can be transparent but which may be colored if desired.

The container 11 consists of a bowl 16 having a generally hemispherical base 17 and an upstanding inwardly inclined substantially straight wall 18 which is circular in cross-section adjoining the hemisphercal base and being inclined upwardly and inwardly to define a circular lip 19 lying in a plane perpendicular to a central axis 20 (see FIG. 3) extending through the center of the hemispherical base 17. The lip 19 defines an opening 21 which opens into the interior space 22 provided within the bowl 16.

This space 22 is sized so as to provide a space for a predetermined quantity of wine as for example 250 ml of wine or ⅓ of a standard 750 ml wine bottle. This is in contrast to a typical small airline bottle which contains approximately 187.5 ml. It should be appreciated that the container 11 can be sized to hold any desired quantity of a liquid. Increases in size can be achieved without destroying the pleasing effect created by the bowl-shaped container 11.

Figure 3:
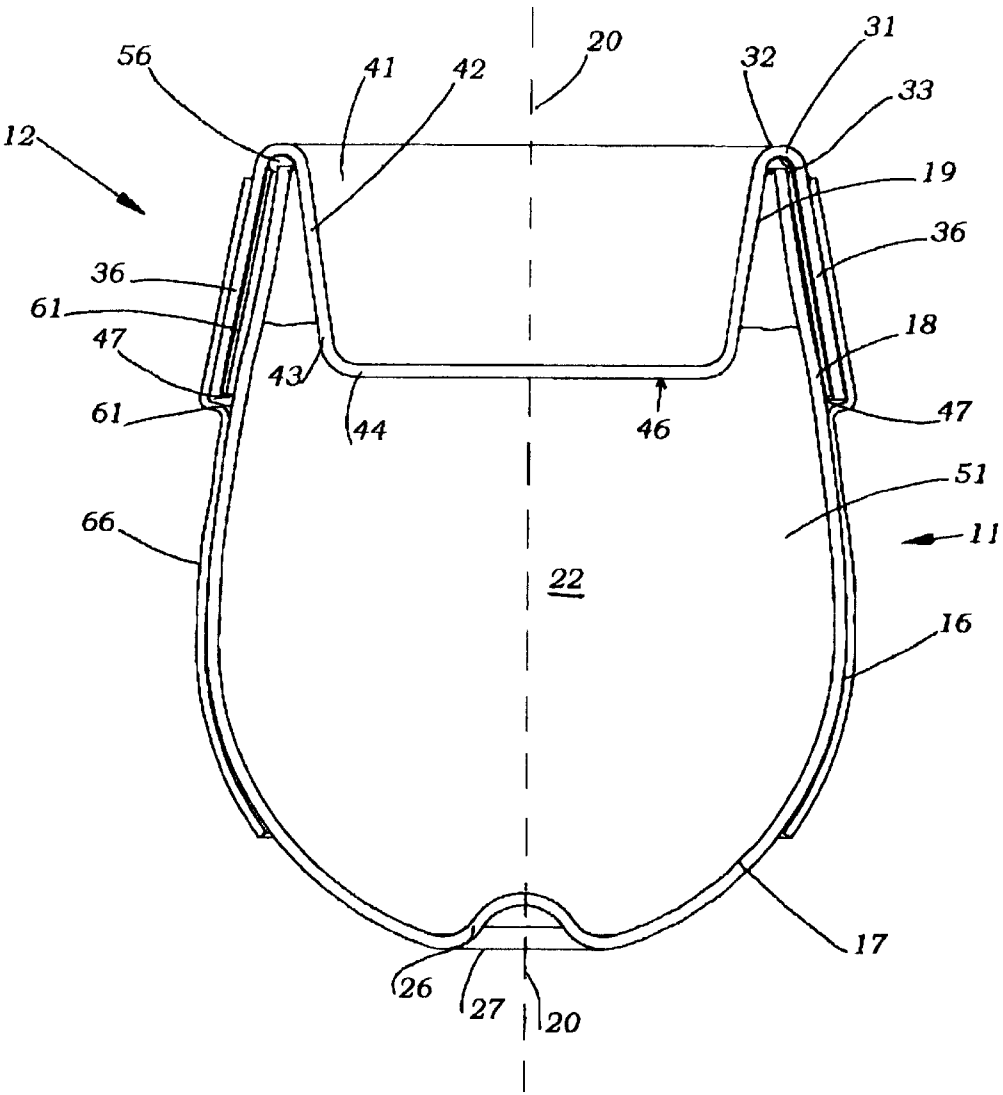
FIG. 3 is a cross-sectional view taken along the line 3—3 of FIG. 1.
Figures 4, 5, 6:
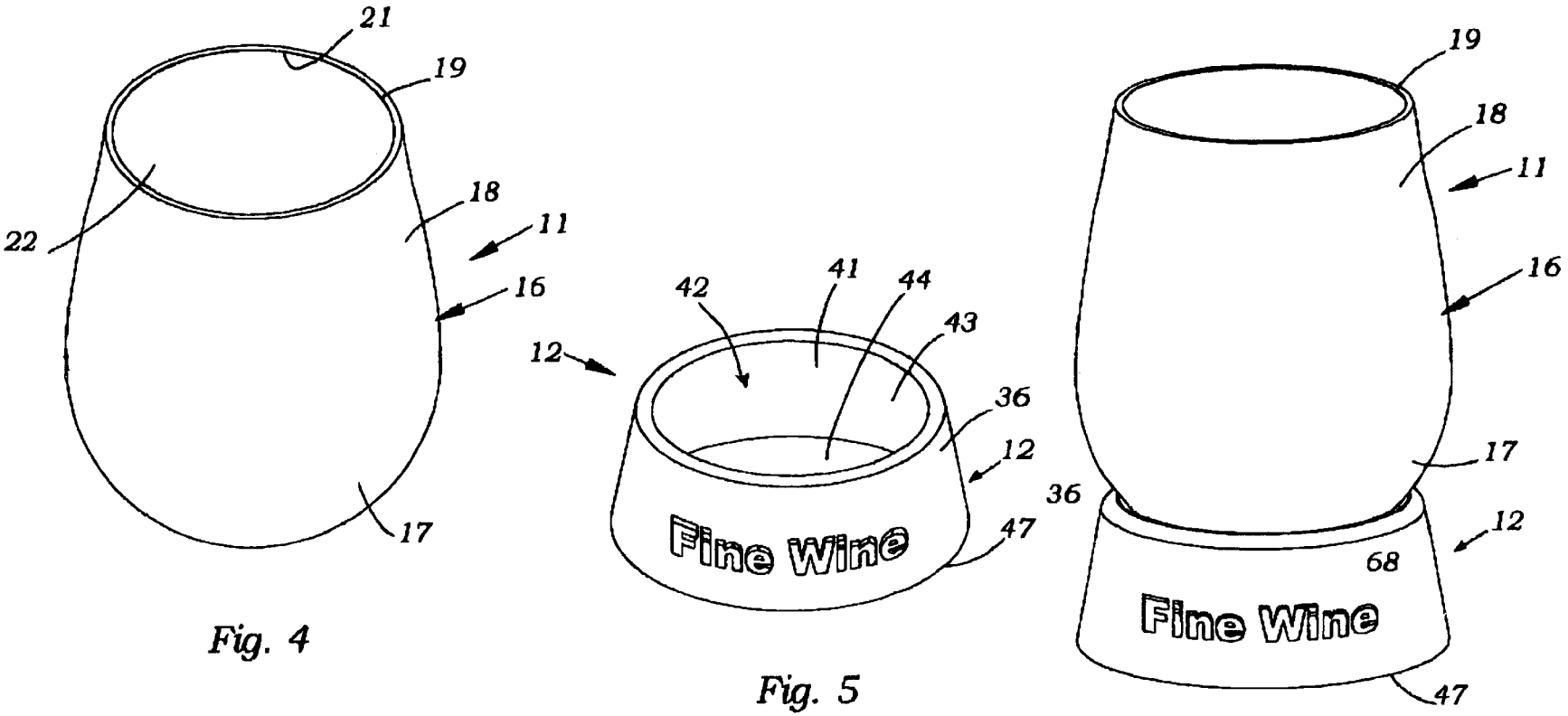
FIG. 4 is an isometric view showing the container being used as a drinking vessel standing by itself.
FIG. 5 is an isometric view of the closure of the present invention positioned for use as a coaster.
FIG. 6 is an isometric view showing the drinking vessel being supported by the coaster.

In order that the bowl 16 of the container 11 can stand by itself, a punt 26 is created in the hemispherical base 17 by creating a push-up in the base 17 as shown particularly in FIGS. 2 and 3. This punt 26 is centrally disposed in the bowl and is concentric with the imaginary axis 20 extending through the bowl perpendicular to the plane of the lip 19. By providing such a punt 26 it can be seen that a bottom circular surface 27 is provided which lies in a plane which is perpendicular to the imaginary axis 20 and also parallel to the plane in which the lip 19 lies. As hereinafter explained, the bottom surface 27 provides an adequate surface so that the bowl can be seated on a flat surface such as that provided by a table to stand by itself. The punt 26 also increases the strength of the bottom of the container 11 so that the container is less fragile.

The closure 12 is comprised of a circular rim 31 which is generally semi-circular in cross-section and which has a rounded outer surface 32 and an inner semi-circular recess 33. A wall 36 which is circular in cross-section adjoins the circular rim 31 and extends downwardly and outwardly from the rim 31 and has a conformation which fits over the upstanding wall 18 of the bowl 16 when the recess 33 of the circular rim 31 is seated over the lip 19 as shown particularly in FIG. 3. The wall 36 extends downwardly for a suitable distance as for example approximately one-third of the height of the vessel or container 11. A cup-shaped well or recess 41 is formed within the interior of the circular rim 31 by a cup-shaped portion 42 having a downwardly and inwardly extending wall 43 circular in cross-section which adjoins the circular rim 31 at its upper extremity and which adjoins a bottom wall 44 extending in a plane generally parallel to the plane of the circular rim 31 and terminates in a circular lip 47 that lies in a plane which is generally parallel to the plane in which the circular rim 31 lies. The bottom wall 44 lies in a plane in which the bottom surface 46 of the wall 44 does not extend below the plane defined by the lip 47 and preferably slightly above the lip 47. The cup-shaped portion 41 performs a significant function as hereinafter explained in that it is designed to consume the ullage space in the bowl 16 of the container 11.

As hereinbefore explained, the space 22 within the bowl 16 can be filled with a suitable liquid as for example wine to a desired level. Since it is intended that the bowl 16 forming the container 11 will be used as a drinking vessel as hereinafter described, the wine 51 is typically filled to a level as for example 1" from the lip to prevent spilling of the wine when the closure 12 is removed and also to prevent spilling upon initial consumption of wine from the bowl 16. The cup-shaped recess portion 41 is sized so that the remaining space in the bowl is occupied by the cup-shaped portion 42 whereby the wine in the vessel substantially completely fills the vessel so that there is very little if any remaining space in the vessel after the closure 12 has been put in place. Since there is very little if any air space remaining in the vessel, preservation of the wine in the bowl 16 is aided.

Means is provided for forming an air-tight seal between the closure 12 and the container 11 and consists of suitable means such as an o-ring 56 formed of a suitable material such as a food-grade silicone. The o-ring 56 is sized so that in cross-section as shown particularly in FIG. 3 the o-ring engages the circular lip 19 of the bowl 16 and is seated within the semicircular recess 33 provided in the rim 31.

A printed label 61 formed of a suitable material such as paper and carrying printing 62 is provided on the outside surface of the upwardly and inwardly extending wall 18 and is dimensioned so that it extends from the lip 47 upwardly to near the top of the lip 19. This paper label 61 extending between the upper extremity of the upstanding wall 18 and the downwardly extending wall 36 prevents glass-to-glass contact between the closure 12 and the container 11.

The seal provided by the o-ring 56 is maintained by applying retention forces between the closure 12 and the container 11 and consists of a securing skirt or a band 66 formed of a heat shrinkable transparent plastic material which is placed over the closure 12 and extends downwardly around the bowl 16 past the region of largest diameter to securely retain the closure 12 on the container 11 while not obscuring the label 62. Other types of securing means can be utilized if desired. Alternatively a paper label (not shown) can be provided on the closure 12 as shown. Also instead of a paper label, lettering such as "FINE WINE" can be placed on the wall 36 of the closure 12.

Use of the combination container and closure 11 and 12 may now be briefly described as follows. Let it be assumed that the container 11 has been filled with an appropriate liquid as for example the wine 51 and the closure 12 put in place with the o-ring 56 forming a sealing engagement between the closure 12 and the container 11 to form an air-tight seal and that it has been closed by the securing band 66.

Let it be assumed that such a combination of the container and closure has been supplied to an ultimate consumer through appropriate channels of trade. It should be appreciated that the combined container and closure can be refrigerated if that is desired for the wine contained therein. When it is desired to consume the wine within the vessel as for example on an airline flight, the closure can be removed by breaking the band 66 in an appropriate manner such as by cutting it with a knife or scissors or alternatively merely by pulling the band off of the container 11 and the closure 12. As soon as this has been accomplished, the container 11 can be placed on a flat surface as for example that provided by a table with the bottom surface 27 provided by the punt 26 serving to maintain the container 11 in an upright position and supporting itself on the surface.

The closure 12 can then be lifted upwardly off of the container 11 taking with it the o-ring 56 contained underneath the rim 31. This closure 12 can then be placed on the same flat surface with the circular lip 47 resting upon the surface so that the cup-shaped recess 41 extends upwardly. After this has been accomplished the container 11 can be lifted from the surface and placed in the closure 12 which now serves as a coaster. The hemispherical base 17 seats within the cup-shaped recess 41 and serves to support the container 11 in a vertical position whereby the container 11 and its contents are insulated from the surface by the coaster 12 and at the same time retaining the container 11 in an upright position so that it cannot tip over.

The container 11 can now be used as a drinking vessel by the consumer grasping the container with his or her hand on raising the container 11 and bringing it to his or her mouth and drinking the wine therefrom as with a conventional wine drinking vessel. The paper label 61 aids in gripping of the container and at the same time the label provides insulation between the fingers of the consumer and the wine within the vessel which may or may not be chilled.

After the wine has been consumed, the container 11 and the closure 12 can be disposed of after a one-time use as for example on an airline. Alternatively, the container 11 and closure 12 can be saved and reused by the consumer when desired. The container 11 and the closure 12 also have the capability of being reused if that is desired.

From the foregoing it can be seen that there has been provided a combination container and closure therefor which can be utilized as a drinking vessel and a coaster. In addition to being utilitarian, the combination has an attractive appearance which particularly lends itself to the packaging of wine. The combination is simple to use and can be economically manufactured and packaged.

What is claimed:

1. A combination of a beverage container having a beverage therein and a closure for use with a planar support surface, the closure comprising a circular rim lying in a plane and having a substantially straight wall circular in cross-section adjoining the rim and extending downwardly and outwardly and terminating in a circular lip lying in a plane substantially parallel to the plane of the circular rim of the closure and resting upon the planar support surface, the beverage container comprising a bowl having a liquid receiving space therein and having a generally hemispherical base with an axis and an upstanding substantially straight wall circular in cross-section adjoining the generally hemispherical base and being inclined upwardly and inwardly to define a circular lip lying in a plane which is perpendicular to the axis of the hemispherical base and providing an opening giving access to said space, said rim of the closure having a recess therein adapted to receive the hemispherical base of the beverage container, the hemispherical base and the rim of the closure being sized so that with the beverage container seated in the rim of the closure, the beverage container is supported by the rim of the closure while permitting the beverage container to be pivoted in the rim of the closure about the axis of the hemispherical base and retaining the beverage container in a position so that any liquid in the container will not spill from the beverage container.

2. A combination as in claim 1 wherein the downwardly and outwardly extending wall is sized so that it can fit over the upstanding wall of the beverage container and close the opening in the beverage container.

3. A combination as in claim 1 wherein said closure is provided with an inwardly depending cup-shaped portion defining the recess and forming a protrusion, said protrusion consuming ullage space in the beverage container when the closure is closing the opening in said beverage container.

* * * * *